US005787871A

United States Patent [19]

Jones et al.

[11] Patent Number: 5,787,871

[45] Date of Patent: Aug. 4, 1998

[54] CUTTING DISC WITH TABS

[75] Inventors: Leon D. Jones, Sandy, Utah; Kevin F. Baron, Agoura Hills, Calif.

[73] Assignee: Western Saw, Inc., Oxnard, Calif.

[21] Appl. No.: 819,001

[22] Filed: Mar. 17, 1997

[51] Int. Cl.[6] ..... B28D 1/04

[52] U.S. Cl. ..... 125/15; 451/542; 451/547

[58] Field of Search ..... 125/15; 451/542, 451/547; 15/13.02

[56] References Cited

U.S. PATENT DOCUMENTS

| | | | |
|---|---|---|---|
| 1,979,905 | 11/1934 | Rogerson | 451/542 |
| 3,221,728 | 12/1965 | Lindblad | 125/15 |
| 3,517,463 | 6/1970 | Niemiec | 51/206.4 |
| 5,433,187 | 7/1995 | Hayasaka et al. | 125/15 |
| 5,465,706 | 11/1995 | Sawluk | 451/542 |

*Primary Examiner*—Robert A. Rose
*Assistant Examiner*—George Nguyen
*Attorney, Agent, or Firm*—Jack C. Munro

[57] ABSTRACT

The subject invention is a cutting disc having a plurality of radial slots connecting with the peripheral edge of the disc which form multiple tabs integrally mounted to the cutting disc with the tabs protruding outwardly from the peripheral edge of the cutting disc. There is at least one tab for each support segment located between directly adjacent radial slots. When fixedly mounting of the cutting segments into the support segments, the cutting segment is also fixed to a tab.

8 Claims, 2 Drawing Sheets

CUTTING DISC WITH TABS

BACKGROUND OF THE INVENTION

1) Field of the Invention

The present invention relates to a cutting disc which is constructed of metal such as stainless steel and has a peripheral edge formed into a plurality of supporting segments by a plurality of spaced-apart radial notches formed within the body of the cutting disc. On the outer surface of each supporting surface there is bonded thereto a cutting segment constructed of a block of an abrasive material which normally includes diamonds which is the primary cutting substance due to their hardness. Cutting discs may be used dry or used with a fluid coolant for cooling the cutting disc. The coolant is to be supplied to the area of cutting with the coolant being for the purpose of cooling the cutting blade and carrying swarf, principally loose rock-like material and coolant, away from the area of the cut being made.

2) Description of the Prior Art

Diamond abrasive cutting discs have generally been classified into three distinct groups. The first group is the serrated or notched peripheral edge type of cutting disc which is old in the art and probably the earliest concept of the diamond cutting disc. This type of cutting disc is made by notching or slitting the peripheral edge of a steel disc and inserting into those notches or slits a paste of diamond grit and a holding material. The paste is then permitted to harden into a solid. This notched rim type of cutting disc has the merit of being virtually indestructible but cuts so poorly that it has no real acceptance for cutting exceedingly hard abrasive material such as cement, stone and asphalt. However, these notched rim types of cutting discs are made at the lowest price which makes such available for home hobby types of operation.

The second group of cutting discs consists of forming a continuous annulus of a compressed metallic powder containing diamond dust. This cutting disc is functionally superior to the notched rim type of cutting disc, but it too is unsatisfactory for the abrasive cutting operations common within industry because it has a disadvantage of being physically frail and susceptible to damage during usage due to the delicate nature of the bond between the annulus and the body of the disc. The use of this second cutting disc is confined in large part to precision operations such as the cutting of germanium, optical glass and other such precise uses.

The third, and most recent group of cutting discs, is the segmental type. This cutting disc is manufactured by forming a plurality of support segments (or lands) located between radial slots connecting with the peripheral edge of the cutting disc. On the outer surface of each support segment is mounted a cutting segment in the form of an abrasive block which commonly contains diamonds. These cutting segments are usually about two inches long and are brazed or welded to the peripheral edge of the steel body of the cutting disc. This type of segmented cutting disc has been accepted by the fields of usage that are most demanding on a cutting disc such as concrete sawing and masonry and asphalt cutting. For such applications, it is common to flush the cutting area continuously during the cutting operation with a fluid coolant in order to keep the blade as cool as possible and to flush from the cutting area loose rock-like material, spent abrasive and the like, all of which in combination with the coolant described are generally referred to as swarf.

Because cutting discs are utilized to cut hard and abrasive materials, it is common that the stresses created result in separation of the cutting elements from the cutting disc. The cutting elements are formed of diamond particles and possibly other types of hard abrasive materials which are bound together in block form. These cutting elements, which have been welded or brazed to the peripheral edge of the cutting disc, can be dislodged from the cutting disc upon sufficient stress being encountered. In the past the attachment process is by welding of the inside surface of the cutting element to the peripheral surface of the disc. There is no further type of securement other than the welding. If the weld breaks, the cutting element becomes dislodged.

SUMMARY OF THE INVENTION

This invention relates to a cutting disc which is constructed of a thin metallic body having a diameter of between a few inches to several feet. The cutting disc has a peripheral edge, and within that peripheral edge is formed a series of radial slots. These radial slots are evenly spaced apart. A common number of such radial slots would be about twenty, but it is to be understood that the number of slots will vary according to the diameter of the cutting disc with more slots being used in a larger diameter disc and less slots being used in a smaller diameter disc. Between each directly adjacent pair of radial slots is formed a support segment or land. On the outer edge of each support segment there is bonded a cutting segment. Integrally protruding from the peripheral edge in the area of each support segment is one or more tabs. These tabs are to provide additional securement area for each cutting segment. The cutting segment comprises a block of abrasive material which generally includes diamonds. Each support segment is usually about one and one-half inch to two inches in length.

The primary objective of the present invention is to construct a cutting disc that provides a high degree of securement to the cutting segments mounted on the peripheral edge of the disc.

Another objective of the present invention is to construct a cutting disc having a longer, more useful life than discs of the prior art intended for equivalent use.

DETAILED DESCRIPTION OF THE PREFERRED EMBODIMENTS

Figure 1:
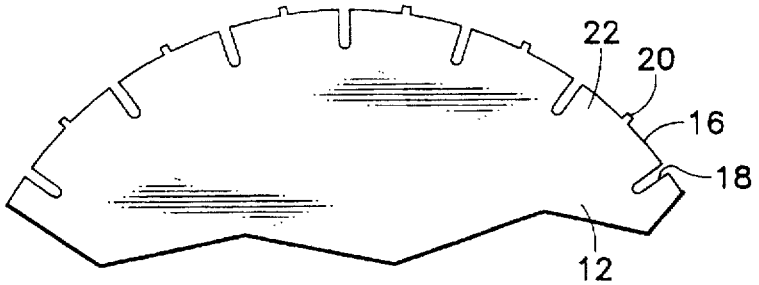
FIG. 1 shows a front view of a portion of the metallic body of the first embodiment of cutting disc constructed in accordance with this invention.
Figure 2:
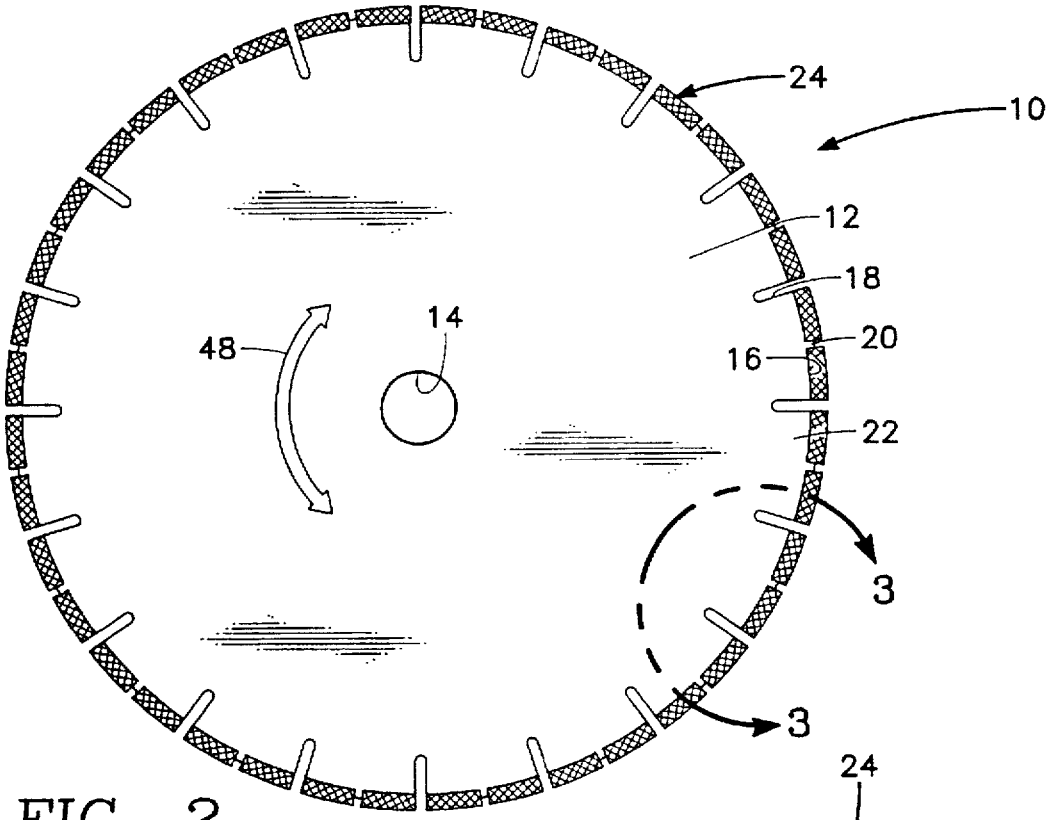
FIG. 2 is a front view of the completely constructed first embodiment of cutting disc of this invention.
Figure 3:
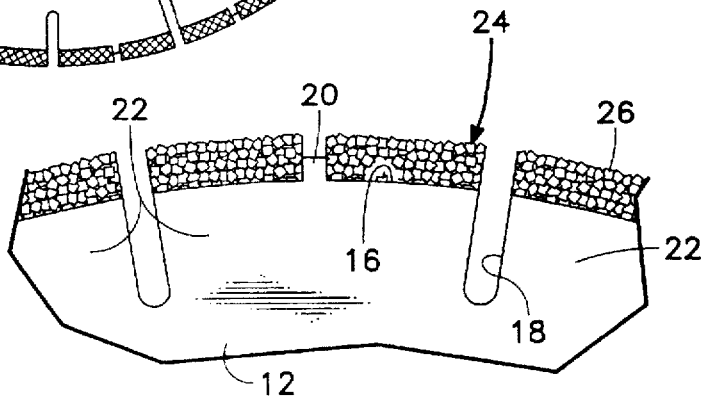
FIG. 3 is an enlarged view of a portion of the first embodiment of cutting disc of this invention taken along line 3—3 of FIG. 2.

Referring particularly to FIGS. 1–3 of the drawings, there is shown a cutting disc 10 which is constructed in a circular configuration and where the body 12 is formed of sheet material metal such as steel. Centrally formed within the body 12 is a hole 14. The hole 14 is for mounting the cutting disc 10 onto a shaft (not shown) which is to be rotated by means of a motor (also not shown) resulting in rotation of the cutting disc 10. The cutting disc 10 includes a peripheral edge 16. Formed within the body 12 and radially extending from the peripheral edge 16 is a plurality of radial slots 18. The use of radial slots 18 is common in cutting discs.

Protruding from the peripheral edge 16 is a plurality of tabs 20. Between each directly adjacent pair of radial slots 18 and integral with the body 12 is a support segment 22. The radial slots 18 are all spaced apart about an equal distance of normally about one and one-half to two inches. Each support segment 22 is almost the same distance between the radial slot 18 with each support segment being located from the inside wall of the radial slot 18 to the outside wall of the next adjacent radial slot 18. The tabs 20 are shown centrally disposed relative to the length of each support segment 22. Each tab 20 is about one-eighth of an inch by one-eighth of an inch in size.

Each cutting segment 24 comprises a block of resin within which is embedded a mass of abrasive particles including diamonds 26. The cutting segments 24 are all identical in size and configuration. The inner surface of the cutting segment 24 is formed arcuate so as to match the curvature of the peripheral edge 16. The wall surface of each cutting segment 24 that abuts against the peripheral edge is to be secured by brazing or welding to the peripheral edge 16. The cutting segment is also to be brazed or welded to one surface of the tab 20. There are two in number of the cutting segments 24 for each support segment 22. The cutting disc shown in FIGS. 1–3 is capable of being rotated in either direction during usage as is represented by arrow 48. The purpose of the tabs 20 is to provide additional surface area for the brazing or welding for the cutting segments 24 and also to provide an upstanding wall surface which functions to mechanically lock the cutting segments 24 in position providing additional securement above the brazing or welding to hold the cutting segments in place.

Figure 4:
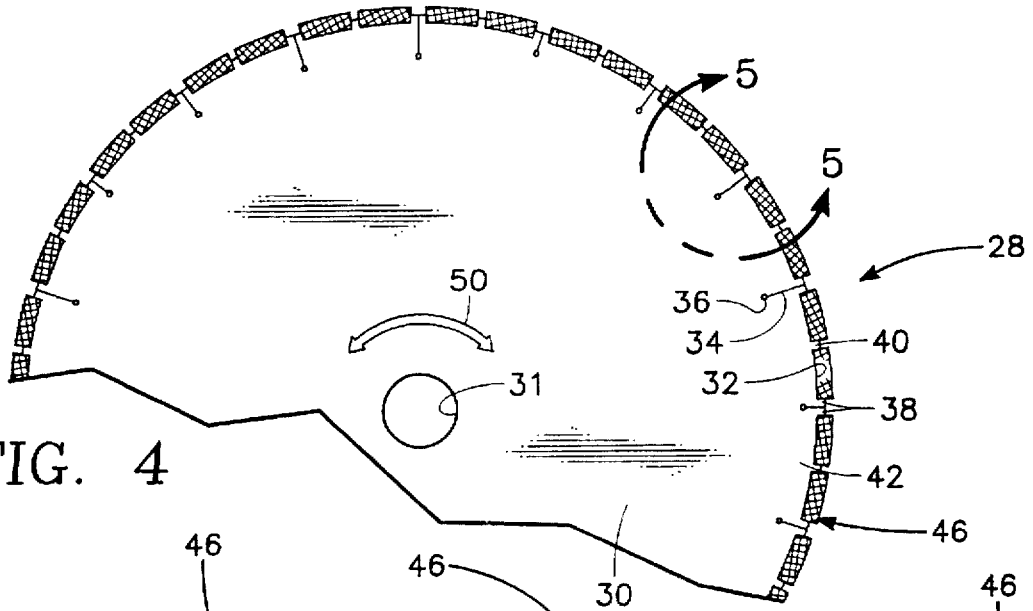
FIG. 4 is a front view of a portion of a second embodiment of cutting disc constructed in accordance with this invention.
Figure 5:
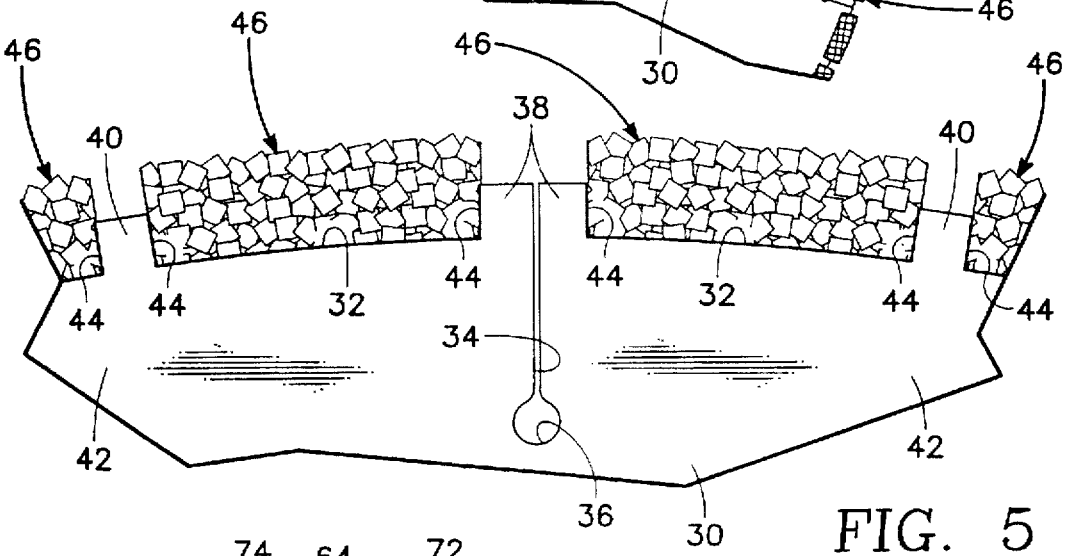
FIG. 5 is an enlarged view of the edge of the second embodiment of the cutting disc taken along line 5—5 of FIG. 4.

Referring particularly to FIGS. 4 and 5 of the drawings, there is shown a second embodiment 28 of cutting disc which is formed primarily of a sheet material metallic body 30. The body 30 has a center hole 31 and a peripheral edge 32. Hole 31 is for the same purpose as hole 14. Connecting with the peripheral edge is a plurality of radial slots 34. The inner edge of the radial slots 34 terminates in a hole 36. It is to be noted that the radial slots 18 shown in FIGS. 1–3 are about an eighth of an inch (0.125") in width whereas in FIGS. 4 and 5 the radial slots 34 are about 0.007 inches in width.

If the narrow type of radial slot 34 is utilized instead of the wider type of radial slot 18, additional tabs 38 can be mounted on the peripheral edge 32 extending outwardly therefrom. There is a tab 38 located on each side of the radial slot 34. There is also a tab 40 positioned at the mid point of the length of the support segment 42. In essence, between a tab 38 and tab 40 there is a concavity 44 with there being two in number of the concavities 44 for each support segment 42. Within each concavity 44 is located a cutting segment 46 similar in construction to the previously discussed cutting segment 24.

If in the embodiment of FIGS. 4 and 5 there is utilized the wider type of radial slots 18, then the number of lineal inches of the cutting surface formed by the cutting segments 46 would be substantially diminished because there are three in number of the tabs 38 and 40 used for each support segment 42. However, since the radial slot 34 is of a substantially lesser width than the radial slot 18, the three in number of the tabs 38 and 40 can be used. It is not only desirable but necessary to have breaks between the cutting segments 46. This facilitates the cutting action. These breaks are naturally provided for by the tabs 38 and 40. The cutting disc shown in FIGS. 4 and 5 can be operated in either direction as represented by arrow 50.

Figure 6:
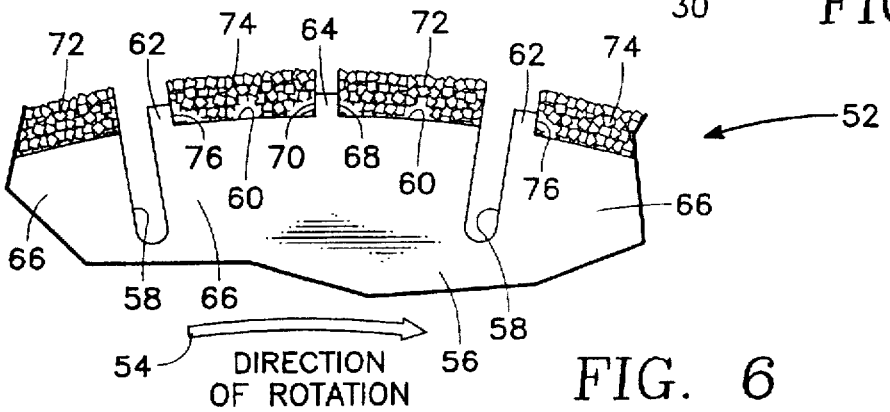
FIG. 6 is a front view of a portion of a third embodiment of cutting disc which is designed to be operated in only one rotative direction as opposed to embodiments of FIGS. 1–5 which can be operated in both directions.

However, in FIG. 6, there is shown a third embodiment 52 of cutting disc of this invention, which is intended to be driven in only one rotational direction as represented by arrow 54. The third embodiment 52 of cutting disc employs a sheet material planer body 56 with radial slots 58 which are essentially identical to the slots 18. Protruding from the peripheral edge 60 are two in number of tabs 62 and 64. Tab 62 is located directly adjacent one of the radial slots 58 with tab 64 being substantially disposed at the approximate mid point of the longitudinal length of the support segment 66. It is to be noted that the tabs 64, according to the direction of rotation of the cutting disc 52, has a leading edge 68 and a trailing edge 70. A cutting segment 72, which is basically identical to the cutting segments 24 and 46, is to be welded to the peripheral edge 60 and abut against the leading edge 68. An identical cutting segment 74 is located between the tabs 62 and 64.

It can be seen that in relation to FIG. 6 the direction of rotation represented by arrow 54 of the third embodiment 52 will produce a force tending to hold the cutting segment 72 tightly against the leading edge 68. This same force will tend to hold the cutting segment 74 in tight contact with the leading edge 76 of the tab 62. In other words, with the embodiment of FIG. 6, the force tends to keep the cutting segments 72 and 74 in tight securement which is not the case within the embodiment 10 of cutting disc shown in FIGS. 1–3. Referring particularly to FIG. 3, assuming that the cutting disc 10 is being rotated clockwise, the force would tend to hold in place the cutting element 24 located on the right side of the tab 20 but tend to remove the cutting element 24 located on the left side of the tab 20. Therefore, using the structural arrangement of FIG. 6, there is a lesser chance that the cutting elements 72 and 74 would be broken free from the body 56.

What is claimed is:

1. A cutting disc for cutting asphalt, concrete, stone and the like, said cutting disc comprising:

a circular shaped body having a peripheral edge;

a plurality of radial slots formed within said body, said radial slots being spaced apart, said body defining a supporting segment located between each directly adjacent pair of said radial slots, each said radial slot having an open outer end connecting with said peripheral edge;

a plurality of tabs integrally mounted to said body, said tabs protruding outwardly from said peripheral edge, there being at least one said tab connected to each said support segment;

at least one cutting segment fixedly mounted on each said support segment at said peripheral edge, there being a pair said cutting segment for each said support segment, a said tab being located between each said cutting segments of each said support segment, each said cutting segment comprising an abrasive block; and each said cutting segment to abut against a said tab.

2. The cutting disc as defined in claim 1 wherein:

there being only one said tab per said support segment.

3. The cutting disc as defined in claim 2 wherein:

said tab being centrally disposed relative to the length of its respective said support segment, said tab being spaced from said radial slots.

4. The cutting disc as defined in claim 3 wherein:

the width of each of said radial slots being approximately 0.125 inches.

5. The cutting disc as defined in claim 2 wherein:

each said tab having a pair of side edges, one said side edge being defined as the trailing edge and the opposite said side edge being defined as the leading edge, said leading edge being moved first into the material that is being cut due to the direction of rotation of said cutting disc, said radial slot having a pair of sidewalls, said trailing edge being in alignment with one of said sidewalls of a said radial slot, a said cutting segment to abut against said leading edge.

6. The cutting disc as defined in claim 5 wherein:

the width of each of said radial slots being approximately 0.125 inches.

7. The cutting disc as defined in claim 1 wherein:

there being three in number of said tabs located in a spaced-apart arrangement for each said support segment, a cutting segment to be mounted between each directly adjacent pair of said tabs of each said support segment.

8. The cutting disc as defined in claim 1 wherein:

there being a pair of said tabs located in a spaced-apart manner in conjunction with each support segment, one said tab of said pair being located directly adjacent a said radial slot, the other said tab of said pair being spaced from said radial slots, both said tabs of said pair having a leading edge which according to direction of rotation of said body moves first into the material that is being cut, there being a pair of said cutting segments mounted with each said support segment with each said cutting segment to abut against a said leading edge of a said tab.

* * * * *